US006866220B2

(12) United States Patent
Sosalla et al.

(10) Patent No.: US 6,866,220 B2
(45) Date of Patent: Mar. 15, 2005

(54) CONTINUOUS MOTION CORELESS ROLL WINDER

(75) Inventors: Gerald K. Sosalla, Appleton, WI (US); Joseph E. Cwiakala, Battlecreek, MI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 45 days.

(21) Appl. No.: 10/036,863

(22) Filed: Dec. 21, 2001

(65) Prior Publication Data

US 2003/0116674 A1 Jun. 26, 2003

(51) Int. Cl.[7] ..... B65H 18/14
(52) U.S. Cl. ..... 242/541.2; 242/541.3
(58) Field of Search ..... 242/541.2, 541.3, 242/535.1, 535.4

(56) References Cited

U.S. PATENT DOCUMENTS

| | | | | |
|---|---|---|---|---|
| 257,761 A | | 5/1882 | Ridgway | |
| 258,895 A | | 6/1882 | Crawshaw | |
| 273,198 A | | 2/1883 | Vaughan | |
| 395,645 A | | 1/1889 | Anderson | |
| 1,195,888 A | | 8/1916 | Wheelwright | |
| 1,235,183 A | | 7/1917 | Butterworth | |
| 1,302,352 A | | 4/1919 | French | |
| 1,316,782 A | | 9/1919 | Frothingham et al. | |
| 1,558,271 A | | 10/1925 | Newell | |
| 1,901,080 A | | 3/1933 | Bradner | |
| 1,956,561 A | | 5/1934 | Coates | |
| 2,025,375 A | | 12/1935 | Cameron et al. | |
| 2,054,113 A | | 9/1936 | Abrahms et al. | |
| 2,059,881 A | | 11/1936 | Lane | |
| 2,066,780 A | | 1/1937 | Holt | |
| 2,119,480 A | | 5/1938 | Codwise | |
| 2,186,957 A | | 1/1940 | Collings et al. | |
| 2,200,656 A | * | 5/1940 | Schefe | 242/535.4 |
| 2,251,295 A | | 8/1941 | Sheesley | |
| 2,257,113 A | | 9/1941 | George | |
| 2,321,938 A | | 6/1943 | Quinn | |
| 2,333,629 A | | 11/1943 | Beadle, Sr. | |
| 2,361,082 A | | 10/1944 | Brown | |
| 2,556,262 A | | 6/1951 | Faeber | |
| 2,562,457 A | | 7/1951 | Hannay et al. | |
| 3,019,130 A | | 1/1962 | Hornbostel | |
| 3,066,046 A | | 11/1962 | Walton | |
| 3,097,968 A | | 7/1963 | Schaefer | |
| 3,315,908 A | * | 4/1967 | Wetzler | 242/535.1 |
| 3,519,214 A | * | 7/1970 | Konrad et al. | 242/535.1 |
| 3,668,905 A | | 6/1972 | Schlunke | |
| 3,766,756 A | | 10/1973 | Farrar | |
| 3,776,482 A | | 12/1973 | Mras | |
| 3,776,763 A | | 12/1973 | Ross | |
| 3,797,281 A | | 3/1974 | Norton | |

(List continued on next page.)

FOREIGN PATENT DOCUMENTS

| | | |
|---|---|---|
| EP | 0 014 520 B1 | 8/1980 |
| EP | 0 014 520 A1 | 8/1980 |
| EP | 0 026 091 B1 | 4/1981 |

(List continued on next page.)

OTHER PUBLICATIONS

SINCRO Brochure, Fabio Perini, S.p.A., 9 pages.
Copy of International Search Report from corresponding PCT application No. PCT/US01/20216, dated Oct. 7, 2002, 3 pages.

(List continued on next page.)

*Primary Examiner*—William A. Rivera
(74) *Attorney, Agent, or Firm*—Brinks Hofer Gilson & Lione

(57) ABSTRACT

A coreless roll winder includes two sets of belts traveling in opposite directions. A cigarette of web material is formed, and the web is wound around the cigarette by the contact with the belts. The roll formed from the winding is transported to the downstream end of the belts and separated from the rest of the web.

21 Claims, 6 Drawing Sheets

U.S. PATENT DOCUMENTS

| | | | |
|---|---|---|---|
| 3,830,143 | A | 8/1974 | Dowd, Jr. |
| 3,844,813 | A | 10/1974 | Leonard et al. |
| 3,853,279 | A | 12/1974 | Gerstein |
| 3,856,226 | A | 12/1974 | Dowd, Jr. |
| 3,873,025 | A | 3/1975 | Qvarnstrom |
| 3,906,893 | A | 9/1975 | Scales |
| 3,949,035 | A | 4/1976 | Dunning et al. |
| 3,980,043 | A | 9/1976 | Pomper |
| 4,045,598 | A | 8/1977 | Henson |
| 4,108,110 | A | 8/1978 | Berry |
| 4,213,218 | A | 7/1980 | Winch |
| 4,247,362 | A | 1/1981 | Williams |
| 4,257,343 | A | 3/1981 | Kullander |
| 4,259,924 | A | 4/1981 | Smith |
| 4,338,876 | A | 7/1982 | Norton |
| 4,447,924 | A | 5/1984 | Bolton et al. |
| 4,485,980 | A | 12/1984 | Gorner |
| 4,487,377 | A | 12/1984 | Perini |
| 4,533,435 | A | 8/1985 | Intili |
| 4,556,454 | A | 12/1985 | Dahl et al. |
| 4,565,155 | A | 1/1986 | Koski |
| 4,583,698 | A | 4/1986 | Nistri et al. |
| 4,590,099 | A | 5/1986 | Reith |
| 4,601,256 | A | 7/1986 | Poterala |
| 4,601,938 | A | 7/1986 | Deacon et al. |
| 4,649,695 | A | 3/1987 | Crouch et al. |
| 4,695,005 | A | 9/1987 | Gietman, Jr. |
| 4,723,724 | A | 2/1988 | Bradley |
| 4,741,944 | A | 5/1988 | Jackson et al. |
| 4,790,491 | A | 12/1988 | Mundus et al. |
| 4,803,194 | A | 2/1989 | Bracewell |
| 4,807,825 | A | 2/1989 | Eisner et al. |
| 4,856,725 | A | 8/1989 | Bradley |
| 4,865,221 | A | 9/1989 | Jackson |
| 4,929,474 | A | 5/1990 | Avni et al. |
| 4,962,897 | A | 10/1990 | Bradley |
| 5,049,440 | A | 9/1991 | Bornhoeft, III et al. |
| 5,076,424 | A | 12/1991 | Nakamura |
| 5,089,296 | A | 2/1992 | Bafford et al. |
| 5,104,055 | A | 4/1992 | Buxton |
| 5,137,225 | A | 8/1992 | Biagiotti |
| 5,152,121 | A | 10/1992 | Nakamura |
| 5,152,471 | A | 10/1992 | Goerner |
| 5,201,164 | A | 4/1993 | Kaufman |
| 5,243,841 | A | 9/1993 | Fleissner |
| 5,271,575 | A | 12/1993 | Weinert |
| 5,275,348 | A | 1/1994 | Looser |
| 5,304,391 | A | 4/1994 | Rantanen |
| 5,314,119 | A | 5/1994 | Watt |
| 5,389,148 | A | 2/1995 | Matsunaga |
| 5,401,315 | A | 3/1995 | Salo et al. |
| 5,402,960 | A | 4/1995 | Oliver et al. |
| 5,449,328 | A | 9/1995 | Schmidt et al. |
| 5,478,027 | A | 12/1995 | Alexander, III |
| 5,501,775 | A | 3/1996 | Kotitschke et al. |
| 5,509,161 | A | 4/1996 | Neveu et al. |
| 5,527,255 | A | 6/1996 | Mansfield |
| 5,538,199 | A | 7/1996 | Biagiotti |
| 5,540,332 | A | 7/1996 | Kopacz et al. |
| 5,542,622 | A | 8/1996 | Biagiotti |
| 5,545,295 | A | 8/1996 | Fujita et al. |
| 5,578,124 | A | 11/1996 | Cleveland et al. |
| 5,603,467 | A | 2/1997 | Perini et al. |
| 5,639,046 | A | 6/1997 | Biagiotti |
| 5,648,083 | A | 7/1997 | Bliesznerr et al. |
| 5,660,349 | A | 8/1997 | Miller et al. |
| 5,690,296 | A | 11/1997 | Biagiotti |
| 5,759,339 | A | 6/1998 | Hartman |
| 5,839,680 | A | 11/1998 | Biagiotti |
| 5,848,756 | A | 12/1998 | Sollinger et al. |
| 5,913,905 | A | 6/1999 | Fleissner |
| 5,958,187 | A | 9/1999 | Bhat et al. |
| 6,056,229 | A | 5/2000 | Blume et al. |
| 6,140,551 | A | 10/2000 | Niemeyer et al. |
| 6,228,216 | B1 | 5/2001 | Lindsay et al. |
| 6,248,211 | B1 | 6/2001 | Jennings et al. |
| 6,444,214 | B1 | 9/2002 | Cole et al. |

FOREIGN PATENT DOCUMENTS

| | | |
|---|---|---|
| EP | 0 026 091 A1 | 4/1981 |
| EP | 0 256 950 A1 | 2/1988 |
| EP | 0 580 561 A2 | 1/1994 |
| EP | 0 641 885 A1 | 3/1995 |
| EP | 0 895 956 A1 | 2/1999 |
| JP | 2-91300 | 3/1990 |
| JP | 5-209395 | 8/1993 |
| JP | 6-306793 | 11/1994 |
| JP | 10174670 | 6/1998 |
| WO | WO 98/03713 | 1/1998 |
| WO | WO 99/29958 | 6/1999 |
| WO | WO 99/33623 | 7/1999 |
| WO | WO 01/40090 A2 | 6/2001 |
| WO | WO 01/82986 A2 | 11/2001 |

OTHER PUBLICATIONS

Copy of Partial International Search Report from corresponding PCT application No. PCT/US01/21030, dated Oct. 28, 2002, 3 pages.

Search Report for Patent Cooperation Treaty application No. PCT/US02/21030, Date of Mailing Feb. 21, 2003, 6 pages.

* cited by examiner

CONTINUOUS MOTION CORELESS ROLL WINDER

BACKGROUND

Disposable sheet products such as paper towels, toilet tissue, and wet wipes have many applications. They may be used with small children and infants when changing diapers, they may be used for house hold cleaning tasks, they may be used for cleaning hands, they may be used as a bath tissue, they may be used as by a caregiver to clean a disabled or incontinent adult, or they may be used in and for a whole host of other applications. Typically, these sheet products have been provided as a stack of separate sheets or as a roll of perforated sheets wound on a solid or hollow core.

Wet wipes have been traditionally been made in processes in which larger webs of wipes are initially made, and then these larger webs are converted into smaller rolls or sheets that can be placed in a dispenser. Embodiments of dispensers are described in application Ser. Nos. 09/565,227 and 09/545,995; in application Ser. Nos. 09/659,307; 09/659,295; 09/660,049; 09/659,311; 09/660,040; 09/659,283; 09/659,284; 09/659,306, filed Sep. 12, 2000; in application Ser. No. 09/748,618, filed Dec. 22, 2000; in application Ser. No. 09/841,323, filed Apr. 24, 2001; in application Ser. No. 09/844,731, filed Apr. 27, 2001; and in application Ser. No. 09/849,935, filed May 4, 2001, the disclosures of which are incorporated herein by reference.

Wet wipes can be any wipe, towel, tissue or sheet like product including natural fibers, synthetic fibers, synthetic material and combinations thereof, that is wet or moist. Examples of wet wipes are disclosed in application Ser. No. 09/564,449; 09/564,213; 09/565,125; 09/564,837; 09/564,939; 09/564,531; 09/564,268; 09/564,424; 09/564,780; 09/564,212; 09/565,623 all filed May 4, 2000; in application Ser. No. 09/223,999, filed Dec. 31, 1998; and in application Ser. No. 09/900,698, filed Jul. 6, 2001, the disclosures of which are incorporated herein by reference.

For sheet products which are provided in roll form, it may be desirable for the roll to be coreless, such that the maximum number of sheets is provided for a given product size. The manufacture of coreless rolls, however, is typically more difficult than the manufacture of cored rolls. The process of winding a cored roll begins with the attachment of a leading edge of a sheet of material to a core, followed by winding the material around the core. The process of winding a coreless roll, however, must be done without the benefit of a pre-formed core around which to wind the sheet. The formation of a roll from a sheet which is already wet is even more difficult, since the surface of a wet sheet tends to have a much lower coefficient of friction than the surface of a dry sheet, reducing the ability to handle the sheet.

There is a need for improved methods for making wet wipes, particularly for making rolls of wet wipes. Typically, wet wipes are manufactured as a roll of dry sheets and are then soaked in a wetting solution. Among other disadvantages, this method can lead to undesirable variations in the properties and performance of the wipes. It is desirable to manufacture wet wipes such that the wetting solution and its ingredients are uniformly distributed throughout the roll. It is also desirable to manufacture coreless rolls of wet wipes, which can be more conveniently packaged and sold.

BRIEF SUMMARY

In an embodiment of the invention there is provided an apparatus for winding a web, comprising: an upstream end;

a downstream end; a first set of belts, traveling within a first plane in a first direction from the upstream end to the downstream end; the belts spaced apart within the first plane; and a second set of belts, traveling within a second plane in a second direction from the downstream end to the upstream end; the belts spaced apart within the second plane; the first and second sets of belts in close proximity at the upstream end and spaced apart at the downstream end; wherein a web, in contact with the first set of belts, traveling in the first direction, and comprising a cigarette comprising a leading edge of the web, is wound around the cigarette by contact with the second set of belts at the upstream end.

These embodiments may further comprise an apparatus wherein the first set of belts travels at a first speed, and the second set of belts travels at a second speed lower than the first speed; wherein the web comprises a liquid add-on of at least about 25%; wherein the web comprises a liquid add-on of about 25% to about 700%; and wherein the web is hydrophobic.

These embodiments may yet further comprise an apparatus wherein the belts of the first set of belts are in alignment with the belts of the second set of belts; the apparatus further comprising a third set of belts positioned between the belts of the first set of belts and in the first plane; the third set of belts traveling in the first direction; the third set of belts comprising a lug on each belt, the lugs oriented along a common line; wherein contact of the lugs with the leading edge of the web forms the cigarette. These embodiments may yet further comprise an apparatus wherein contact of the lugs with the web separates the web into a downstream portion and an upstream portion; the upstream portion comprising the leading edge.

These embodiments may yet further comprise an apparatus wherein the belts of the first set of belts are in alignment with the space between the belts of the second set of belts; the apparatus further comprising a first set of skatewheels positioned between the belts of the first set of belts; and a second set of skatewheels positioned between the belts of the second set of belts, and positioned downstream from the first set of skatewheels; wherein the first set of skatewheels pins the web against the second set of belts, and the second set of skatewheels pins the web against the first set of belts; the skatewheels cooperating to separate the web into a downstream portion and an upstream portion; the upstream portion comprising the leading edge, and the first set of skatewheels forming the cigarette.

These embodiments may yet further comprise a fourth set of belts comprising belts spaced apart within a fourth plane and traveling in the first direction; and a fifth set of belts comprising belts spaced apart within a fifth plane parallel to the fourth plane and traveling in the first direction; the belts of the fifth set of belts in alignment with the belts of the fourth set of belts; the fourth and fifth sets of belts delivering the web to the first set of belts. These embodiments may yet further comprise a sixth set of belts comprising belts positioned between the belts of the fourth set of belts and moving from a position behind the fourth plane to a position beyond the fourth plane; and a plurality of surfaces positioned between the belts of the fifth set of belts; the motion of the sixth set of belts to the position beyond the fourth plane causing the web to be pinned between the surfaces and the sixth set of belts and separating the sheet into an upstream portion and a downstream portion.

In another embodiment of the invention there is provided a method of forming a coreless roll of product, comprising supporting a web on a first set of belts traveling in a first direction from an upstream area to a downstream area; forming a cigarette from the web; contacting the cigarette with a second set of belts traveling in a second direction from the downstream area toward the upstream area; and winding the web around the cigarette.

These embodiments may further comprise a method comprising breaking the web to form an upstream portion of the web and a downstream portion of the web, the upstream portion comprising a leading edge; wherein the cigarette comprises the leading edge. These embodiments may yet further comprise a method wherein the breaking the web and the forming a cigarette from the web are simultaneous; wherein the breaking the web is followed by the forming a cigarette from the web; wherein the breaking the web comprises contacting the web with a plurality of lugs, the lugs attached to a third set of belts positioned between the belts of the first set of belts; and wherein the breaking the web comprises simultaneously pinning the web between a first set of skatewheels and the second set of belts and pinning the web between a second set of skatewheels and the first set of belts.

These embodiments may yet further comprise a method wherein the first set of belts travels at a first speed, and the second set of belts travels at a second speed lower than the first speed; and wherein the web comprises a liquid add-on of at least 25%.

In another embodiment of the invention, there is an apparatus for forming a coreless roll of product, comprising means for transporting the web from an upstream end of the apparatus to a downstream end of the apparatus; means for separating the web into an upstream portion and a downstream portion, the upstream portion comprising a leading edge; means for forming a cigarette comprising the leading edge; means for rolling the cigarette onto the web; means for winding the web around the cigarette to form a roll; and means for transporting the roll to the downstream end. These embodiments may further comprise an apparatus wherein the web comprises a liquid add-on of at least 25%.

DETAILED DESCRIPTION

A method for making coreless rolls of sheet product is provided which in general includes winding a substrate into a roll. The method may include contacting a sheet of substrate with at least one belt on at least two opposing sides of the sheet, such that the belts travel in opposite directions. An apparatus for performing the method is also provided.

Figure 1:
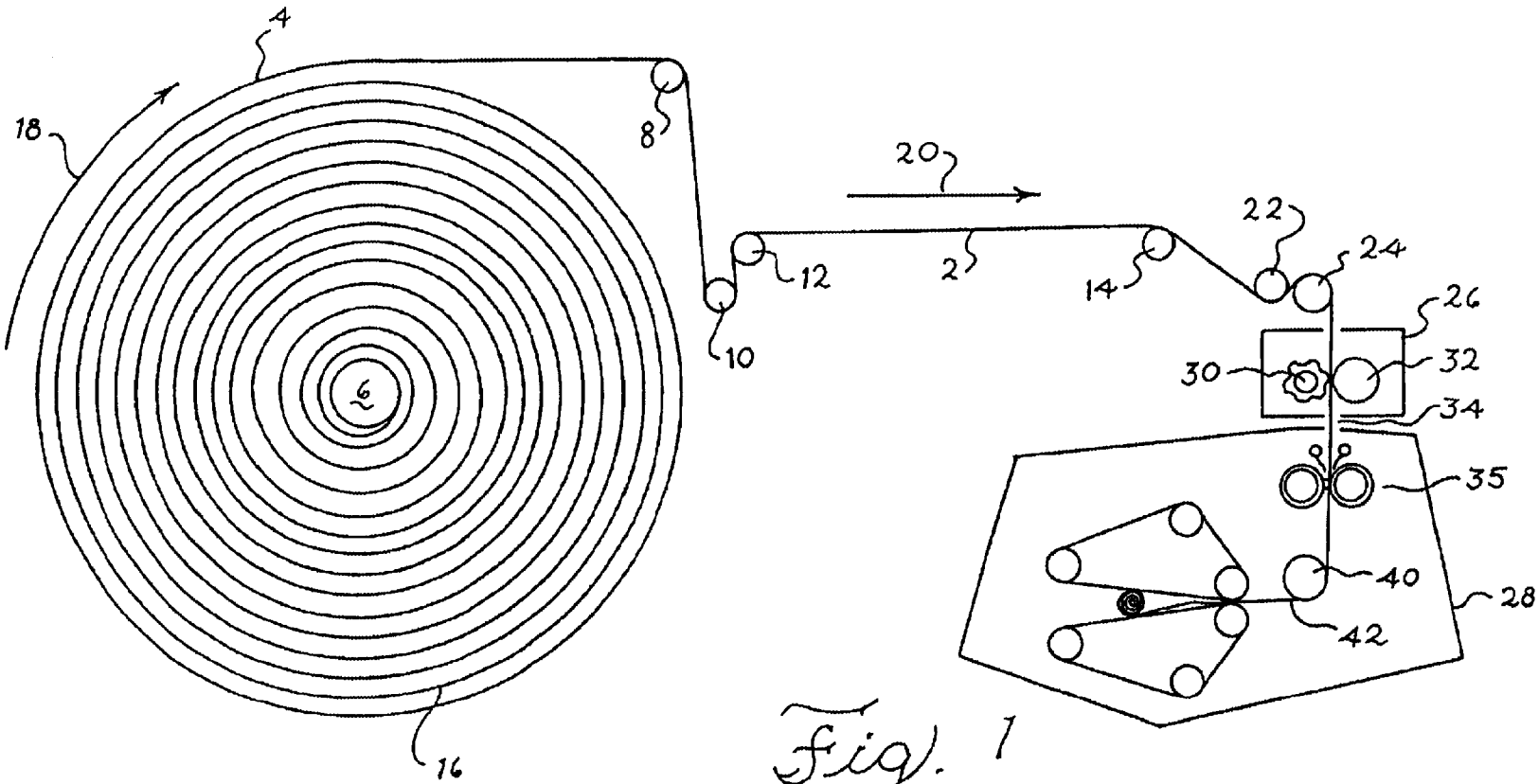
FIG. 1 is a diagrammatic view of an apparatus connected to a parent roll.

Referring to FIG. 1, there is in general provided a web of material 2. This source web may be any type of basesheet known to those skilled in the art. For example, the web may be a wet-formed basesheet such as a tissue or towel basesheet. The web may be a non-woven basesheet, such as an airlaid, spun-laid, hydroentangled, spun-bond, or melt-blown basesheet. The web may be a multi-layer basesheet, such as a laminate of any combination of these basesheets. The basesheet may contain a binder, for example a non-dispersible binder, such as a latex binder or a cross-linkable binder; or a water-dispersible binder, such as a temperature-sensitve water dispersible binder or an ion-sensitive water dispersible binder. Ion-sensitive water-dispersible binders, such as those disclosed in the above-referenced co-pending patent applications, provide for water dispersibility of 80% or greater. Water dispersibility is defined as: 1 minus (the cross-direction wet tensile strength in water, divided by the original cross-direction wet tensile strength of the wet wipe), multiplied by 100%. Examples of individual webs include a melt-blown basesheet with a latex binder; a spun-bond basesheet with a temperature-sensitve water dispersible binder; and an airlaid basesheet with an ion-sensitve water dispersible binder.

The web is delivered to the wetting and winding apparatus 1 as a sheet of material. The web may be unwound from a roll, or it may be fed to the apparatus directly from a web making apparatus. The web may be a single sheet, or the web may have multiple sheets which are combined to form a multi-ply sheet. Multi-ply sheets may be bonded together, for example with adhesives, thermal bonding, sonic bonding, or hydroentanglement. Referring to FIG. 1, the web may be dispensed from a parent roll 4 which can be mounted on a rotating shaft 6. The spiral wind 16 of the parent roll allows the roll to be unwound in the direction of arrow 18. The unwinding of the roll can be controlled such that the web is dispensed at a consistent speed and tension even though the size of the roll is decreasing. The web is delivered in the form of a sheet to the wetting apparatus 35 in the direction of arrow 20. The delivery may be controlled by a series of rollers (8, 10, 12, 14, 22, 24) to adjust the speed of the delivery and/or the tension applied to the web. These rollers may independently be, for example, dancer rollers, idler rollers, draw rollers, or bowed rollers. The speed of the web may be at least 60 meters per minute (m/min). Preferably, the speed of the web is at least 80 m/min; more preferably at least 150 m/min; more preferably still at least 300 m/min.

There may optionally be a device for perforating the web. The perforation may be accomplished by a pair of rollers, wherein at least one of the rollers comprises a series of teeth or blades such that the impact of the rollers on the web results in incisions in a line forming a perforation line. The incisions within the perforation line may be spaced regularly, they may be spaced randomly, or they may be spaced in a controlled arrangement. The perforations are preferably in the cross direction (CD) of the web; that is, in the plane of the web perpendicular to the direction of movement, or the machine direction (MD). The perforation may be accomplished by methods known to those skilled in the art. For example, a perforating apparatus as described in U.S. Pat. No. 5,125,302, incorporated herein by reference, may be used to perforate the web.

The web may be treated with a wetting solution to provide a wet web. Referring to FIG. 1, a wetting solution may be applied to the web by wetting apparatus 35, and the wet web 42 is then delivered in the direction of arrow 20 to the winder 41. This delivery may be accomplished by the use of rollers or belts such as roller 40. Care must be taken in handling the wet web since the presence of moisture in the web can alter the physical properties of the material. For example, incorporation of 225% by weight of a wetting solution can increase the percent elongation at failure (i.e. "stretch") of a web from 5–10% to 25–40%. In general, the strength of the web is also decreased upon application of a given wetting solution. Typically, perforations also will diminish the strength of the wet web. The wetting and winding apparatus 35 and 41 may be enclosed in a containment box 28 to which the web 34 is delivered.

Examples of wetting apparatus for wetting a web of material are given in co-pending applications Ser. Nos. 09/900,746 and 09/900,516 filed Jul. 6, 2001. Examples of wetting solutions are given in the above mentioned U.S. applications Ser. Nos. 09/564,449; 09/564,213; 09/565,125; 09/564,837; 09/564,939; 09/564,531; 09/564,268; 09/564,424; 09/564,780; 09/564,212; 09/565,623; and 09/223,999. Preferably, the wetting solution is added to the web with an add-on greater than about 25%. The amount of liquid or wetting solution contained within a given wet web can vary depending on factors including the type of basesheet, the type of liquid or solution being used, the wetting conditions employed, the type of container used to store the wet wipes, and the intended end use of the wet web. Typically, each wet web can contain from about 25 to about 600 weight percent and desirably from about 200 to about 400 weight percent liquid based on the dry weight of the web. To determine the liquid add-on, first the weight of a portion of dry web having specific dimensions is determined. The dry web corresponds to the basesheet which can be fed to the wetting and winding apparatus. Then, the amount of liquid by weight equal to a multiple (e.g. 1, 1.5, 2.5, 3.3, etc., times) where 1=100%, 2.5=250%, etc., of the portion of the dry web, or an increased amount of liquid measured as a percent add-on based on the weight of the dry web portion, is added to the web to make it moistened, and then referred to as a "wet" web. A wet web is defined as a web which contains a solution add-on between 25% and the maximum add-on which can be accepted by the web (i.e. saturation). Preferably, the wetting solution add-on is between about 25% and 700%; more preferably between 50% and 400%; more preferably still between 100% and 350%; more preferably still between 150% and 300%; more preferably still between 200% and 250%.

The wetting solution can be applied by methods known to those skilled in the art. The wetting apparatus may contain, for example, a fluid distribution header, such as a die with a single orifice; a drool bar; a spray boom, such as a boom with multiple nozzles; or press rolls. The apparatus may contain, for example, a fluid distribution header with an adjustable die. The size of the orifice in the die, the temperature of the die, and the volume of solution applied may be controlled such that the liquid exits the die with a uniform pressure, temperature, and geometry. The wetting apparatus may include the use of a nip to improve distribution and absorption. Solution application may be accomplished by the use of other apparatus known to those skilled in the art. For example, the web may be passed through a bath or trough containing the wetting solution. The web may be wetted by contact with a material that is wet, such as a wetted belt or roller or a wet sponge. The application of solution may be accomplished in more than one step; that is by two or more wetting steps, which may be the same or different.

Referring to FIG. 1, the wetting apparatus may optionally include a detour roller 40 positioned to contact the web after the solution application and before the wet winding. This roller assists in transferring the wet web from the wetting apparatus to the winding apparatus. The detour roller can provide a frictional surface to ensure adequate tension in the web. This can be especially advantageous during the separation of a completely wound wet log from the rest of the web. Also, the detour roller can provide a preferred geometry between the web and the winding apparatus to ensure adequate contact between the wet web and the upper winding roller of the winding apparatus.

Figure 2:
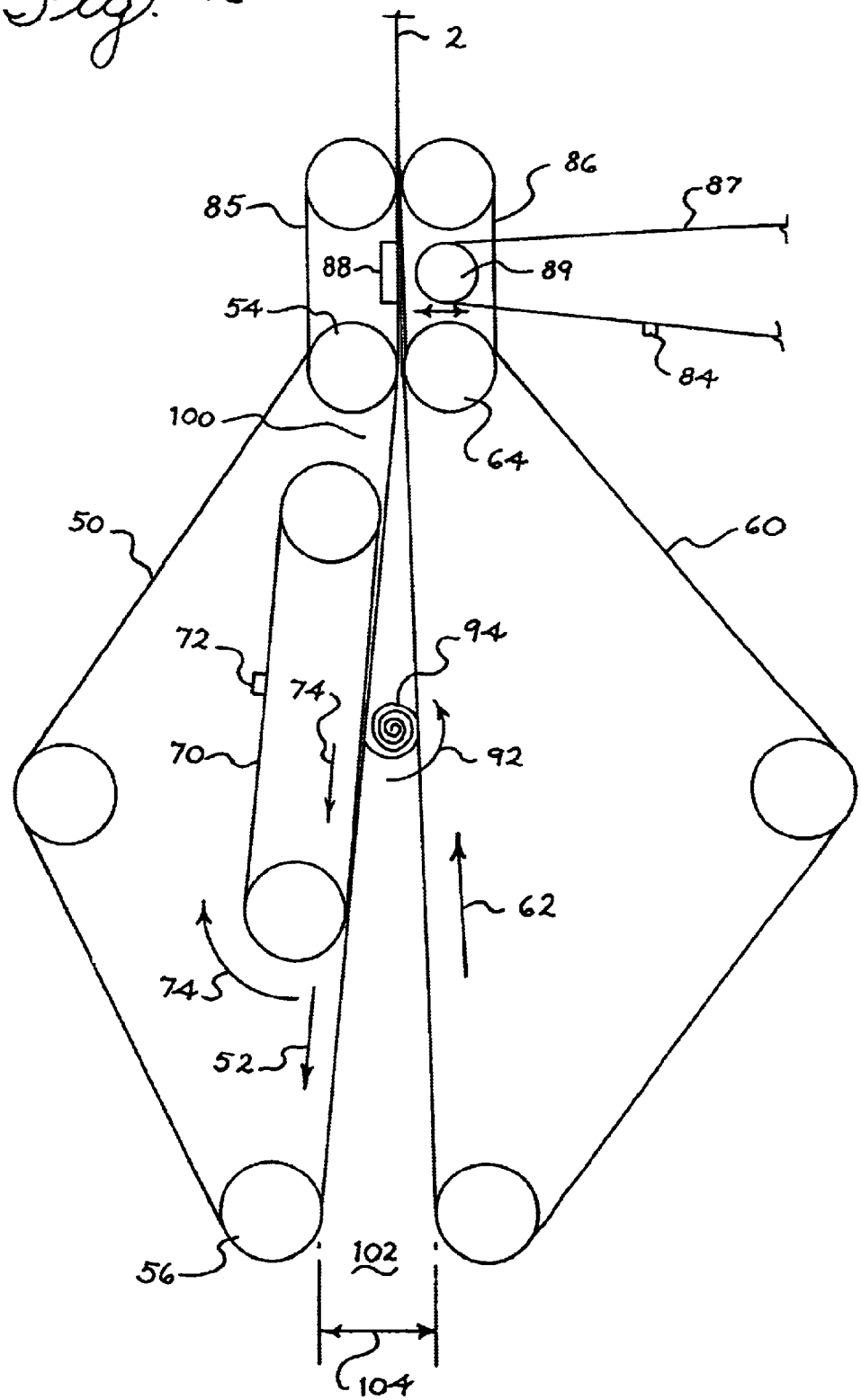
FIG. 2 is a side view a winding apparatus.
Figure 7:
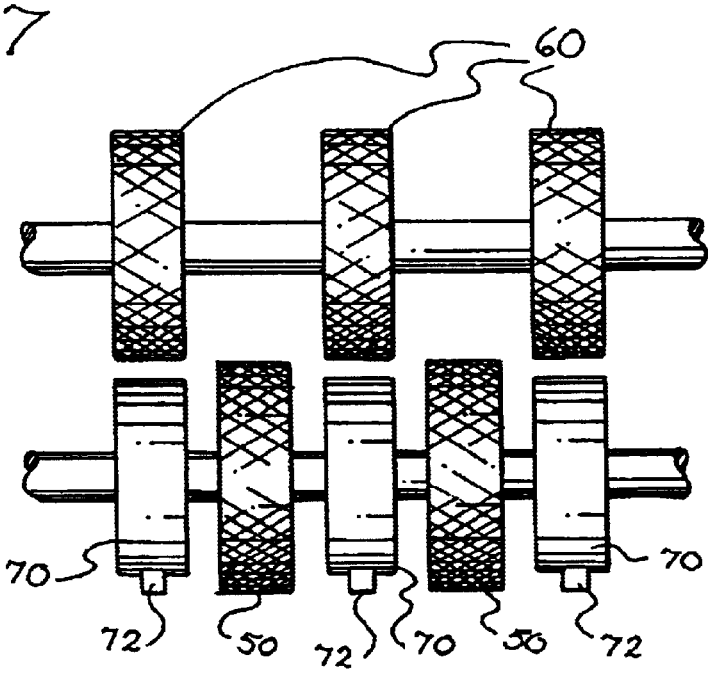
FIG. 7 is partial view from upstream to downstream of a winding apparatus.

After any desired intermediate processing steps have been performed, the sheet product is directed to the winding apparatus. The winder contains at least two belts, with one belt positioned on one side of the sheet and another belt positioned on the opposite side of the sheet. Preferably, the winder contains a plurality of belts divided into two sets. Referring to FIG. 2, one set of belts 50 is positioned on one side of the sheet 2, and the other set of belts 60 is positioned on the other side of the sheet. All the belts within a set move in the same direction and are spaced apart by a given distance in the cross direction (CD) (FIG. 7). The two sets of belts move in opposite directions along arrows 52 and 62. The winding belts together define an upstream end 100 and a downstream end 102.

The belts preferably have a high friction surface. For example, the belts may have a surface which is tacky, for example a surface of a rubber or an elastomer. The belts may have a surface which has a surface roughness greater than 250 roughness average (Ra). Roughness average is measured by a profilometer, and is based on a graphical centerline, which is the line through the profile of the surface where the sums of the area on either side of the line (peaks and valleys) are equal. Roughness average is defined as the arithmetic average of the height of the peaks above the graphical centerline over a given area, and is expressed in units of microinches (0.000001 inch). The graphical centerline is the least-squares best fit line through the profile data. An example of a profilometer is the Model S5 TALYSURF Surface Profilometer (RANK TAYLOR HOBSON, LTD., Leicester, England). The Ra of a surface can be measured following the procedures described in U.S. Pat. No. 6,140,551, which is incorporated herein by reference, using a single line trace of the surface and a "cut-off" length of 0.8 mm. For example, an 8 mm sampling length would consist of 10 cut-offs of 0.8 mm each.

The sets of winding belts are configured such that the belts on one set diverge from the belts on the other set in the downstream direction. The belts travel on upstream pulleys 54 and 64 that cause the sets of belts to be close to each other at the upstream end 100, where the web is fed into the winder. The upstream pulleys may be on direct opposite sides of the sheet, or they may be offset (see, for example FIG. 3). The pulleys 56 and 66 at the downstream end 102 are separated by a distance 104. This distance is at least as large as the desired diameter of the roll of product.

Figure 3:
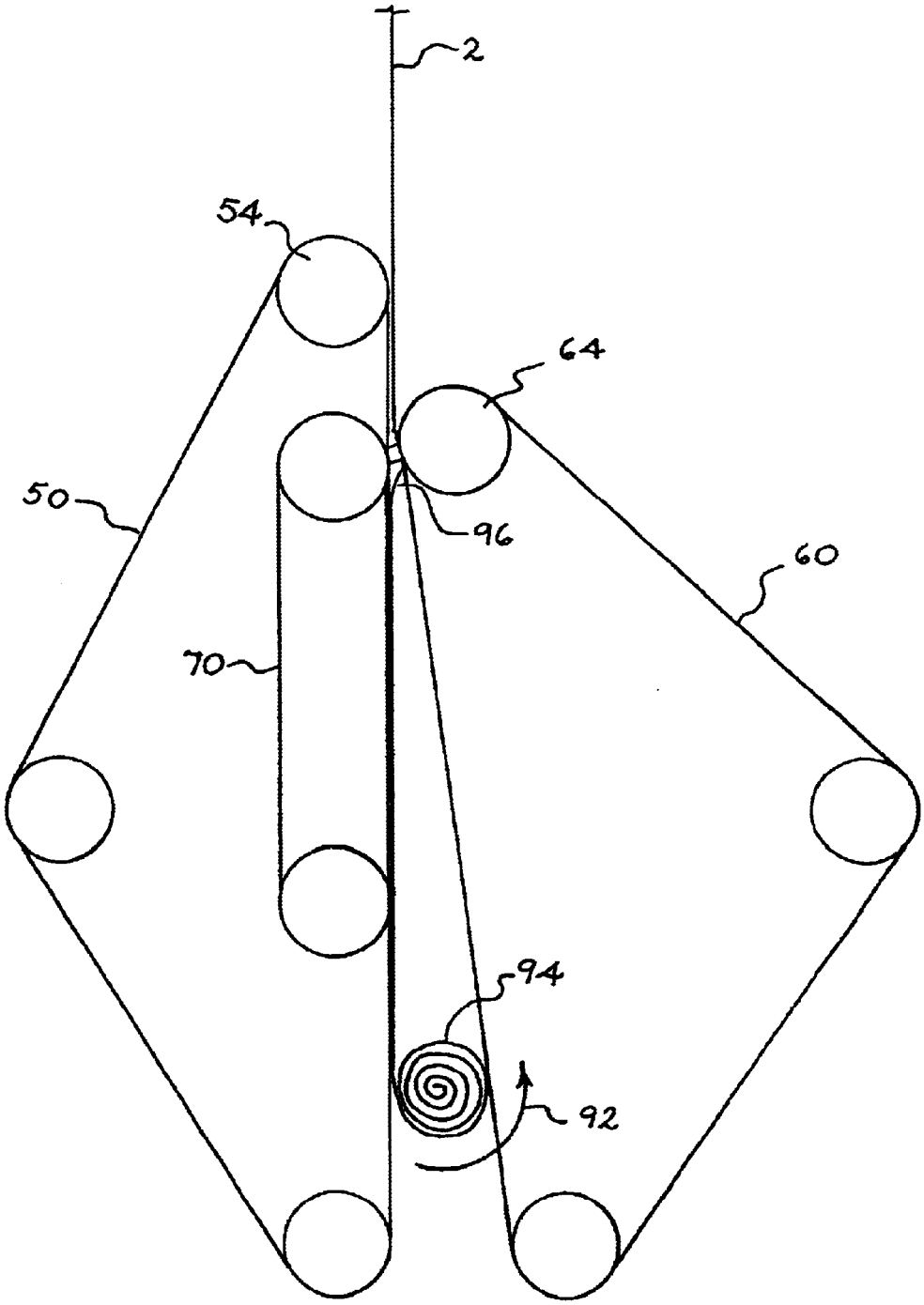
FIG. 3 is a side view of a winding apparatus.

Referring to FIGS. 2 and 3, as the web 2 is fed into the winder it initially is in contact only with the set of support belts 50, which is moving in the same direction as the web. When a small roll 90, referred to as a cigarette, has been formed from a leading edge of the sheet (FIGS. 4–5), the impact of the second set of belts 60 on the portion of the roll which is away from the first set of belts imparts angular momentum to the roll. This causes the roll to rotate, in the direction of arrow 92, back onto the portion of the web which has more recently entered the winder. This rotation causes the web to wind into a larger roll 94, and the rotational motion of the roll is maintained by the contact of the two sets of belts in opposite directions on opposite sides of the roll. Preferably, the second set of belts moves at a slightly slower speed than the support belts, allowing the roll to have a net motion towards the downstream end of the winder. This roll formation continues until a trailing edge 96 is formed and is brought into contact with the rest of the roll. The fully formed roll then travels to the downstream end of the winding belts and may be discharged. The leading edge 99 (FIG. 4) of the next portion of the web is then formed into a cigarette 90 to begin the formation of a new roll.

Figure 4:
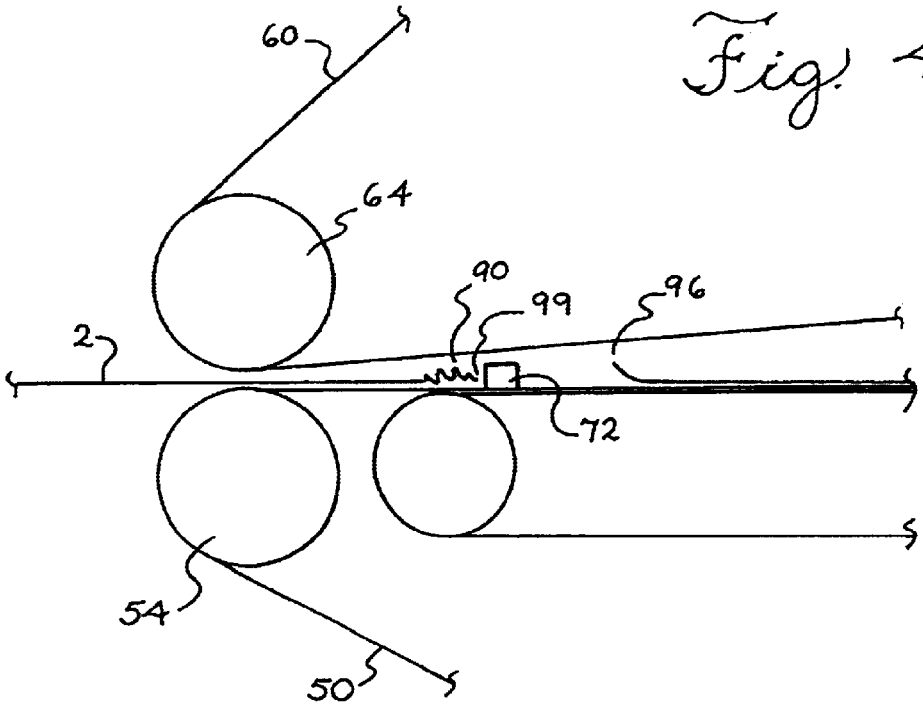
FIG. 4 is a partial side view of the upstream region of a winding apparatus.
Figure 5:
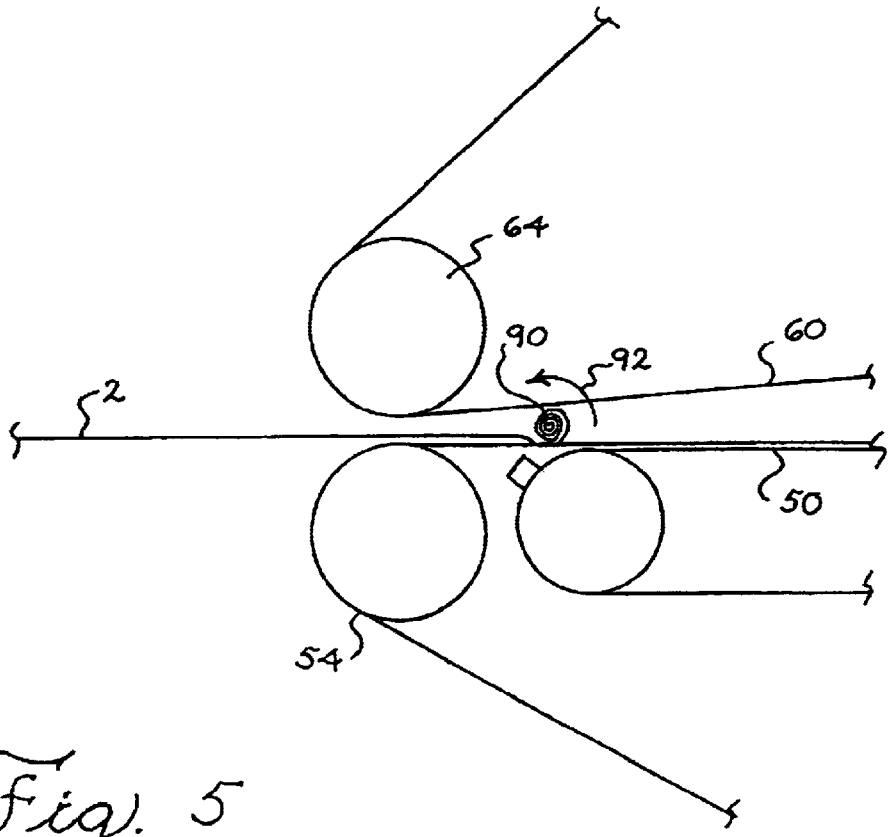
FIG. 5 is a partial side view of the winding apparatus of FIG. 4.

Referring to FIGS. 4 and 5, the formation of the cigarette can be accomplished by a variety of methods. The cigarette formation may be combined with a breaking of the sheet, or the cigarette formation may be done subsequent to the breaking of the sheet. In general the cigarette is formed by bunching up the area of the web adjacent the leading edge 99 until the size of the bunched portion is sufficient to make contact with the set of belts traveling upstream. Preferably, this breaking of the web occurs along a line of perforation in the web.

Figure 8:
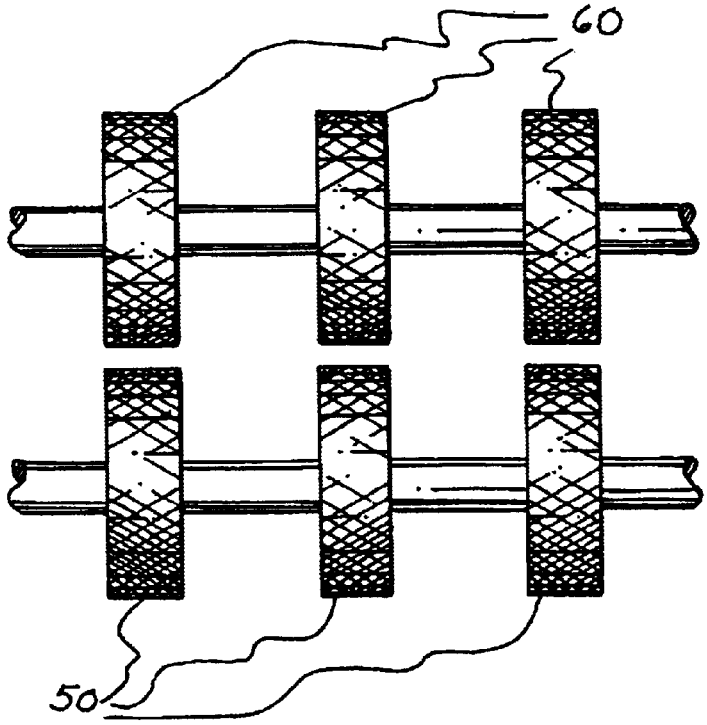
FIG. 8 is a partial view from upstream to downstream of a winding apparatus.

In one aspect, the belts on each set are spaced such that the belts on one set are in line with the belts on the other set (FIG. 8). Referring to FIGS. 2–5, as the leading edge of the web passes between the winding belts at the upstream end, the web is contacted by a set of timing belts 70. The timing belts are spaced to fit between the individual belts of the supporting belts 50. The timing belts are equipped with at least one lug 72 per belt which are in aligned in the cross direction. The timing belts travel in the same direction 74, but at a slower speed than the web and the supporting belts 50. The lugs contact the web once for a given roll formation cycle. As the lugs on the belts encounter the leading edge, they retard the motion of the leading edge and the portion of the web adjacent the leading edge, forming the cigarette. This cigarette can then be formed into a roll by the winding belts. Referring to FIG. 3, the set of timing belts 70 and the set of winding belts 60 can be positioned such that the lugs pin the web against the belts. In this configuration, the web can be broken and the cigarette can be formed in a simultaneous process. The lugs may be configured to break the web without pinning the web against the winding belts. As the lugs pass between the supporting belts 50 to impinge on the web, the motion of the portion of the web in contact with the lugs can be retarded such that a stress is applied to the web. This stress can break the web along the line of lugs, creating a new leading edge 99 to be formed into a cigarette 90.

Figure 6:
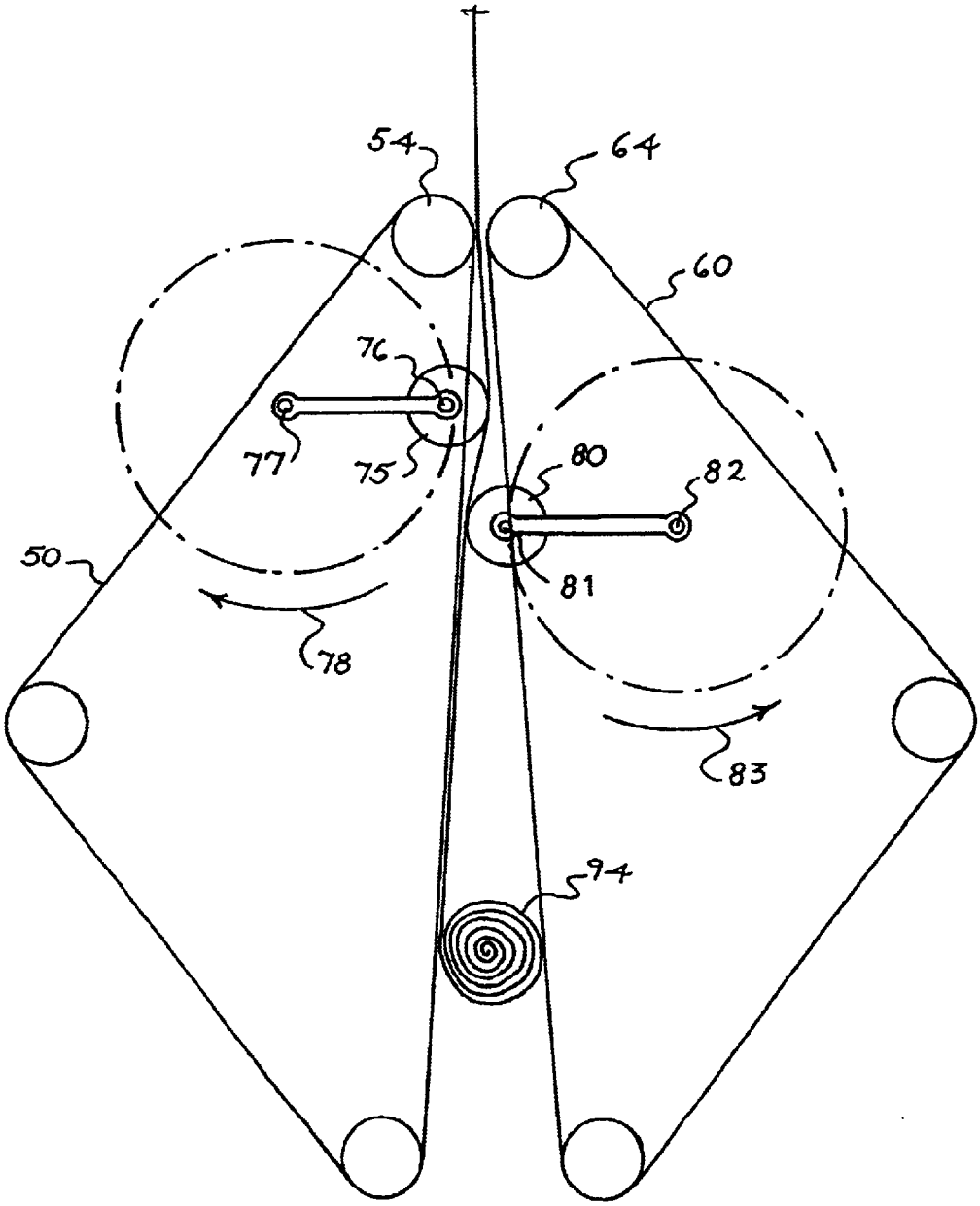
FIG. 6 is a side view of a winding apparatus.

In another aspect and referring to FIG. 6, the winding belts are arranged in a staggered configuration such that the belts on one set correspond to the spaces between the belts on the other set. Two sets of skatewheels 75 and 80 are provided on either side of the web. Each set of skatewheels can freely rotate on its own common shaft 76 and 81, and each set of shaft and wheels rotate about a separate axis 77 and 82. The upstream set of skatewheels 75 is mounted behind the supporting belts 50. As the skatewheels pass between the belts in the direction of arrow 78, they contact the web, separating the web from the supporting belts and nipping the web against the opposing belts 60. In a similar manner, the downstream set of skatewheels 80, mounted behind and passing through the opposing belts 60 in the direction of arrow 83, can contact and separate the web from the opposing belts, nipping the web against the supporting belts. The motion of the skatewheels is coordinated, with each set of skatewheels passing through its associated set of belts one time for each roll that is produced. For a web of material traveling along the supporting belts, the nipping of the web between the downstream skatewheels and the supporting belts is followed by the corresponding nipping between the upstream skatewheels and the opposing belts. These forces on the web cooperate to strain the web and separate the web into an upstream portion and a downstream portion. The downstream portion forms a trailing edge, which becomes the tail of a finished roll product. The upstream portion forms a leading edge and is used to begin the formation of another roll of product.

Referring again to FIG. 2, the winder may optionally include parallel infeed belts 85 and 86 to assist in feeding the web to the winding belts. The infeed belts may coordinate with a set of perforation breaking belts 87 and stops 88. These belts may have at least one protrusion, or lug 84, and these lugs are in alignment from one belt to the other. The breaking belts and the pulley 89 are spaced to fit between the individual belts of one set of infeed belts. Between the belts of the other set of infeed belts are placed the stops, which are separated from the pulley 89 by a distance equal to the height of the lugs on the belts. When a web is traveling between the two sets of infeed belts, the lugs on the breaking belts coordinate to pinch the web against the stops periodically. If the web is perforated, this pinching preferably occurs along a line of perforations in the web. The action of the breaking belts and stops on the web serves to pull the web apart, forming a leading edge and a trailing edge.

It is preferred that the materials used for the wetting and winding apparatus, as well as any equipment which is in contact with the wetting solution, are resistant to corrosion. The apparatus and their components may also be coated with corrosion resistant materials. Examples of corrosion resistant materials include 316L stainless steel, nickel and its alloys, tungsten carbide, nylon, and poly (tetrafluoroethylene) (TEFLON, DUPONT). The components of the apparatus may be controlled by standard controlling equipment and software. For example, the apparatus may be controlled and monitored with a standard programmable logic controller (PLC). Individual apparatus may have separately controls, and these controls may be operably linked with the main control for the overall apparatus. For example, the winding apparatus may be controlled and monitored with a PanelMate Human Machine Interface (HMI). The HMI can control the starting, stopping, and other parameters that affect the wetting and winding of the web. The HMI may interface to the PLC (Programmable Logic Controller) that actually controls the machine.

What is claimed is:

1. An apparatus for winding a web, comprising:

an upstream end;

a downstream end;

a first set of belts, traveling within a first plane in a first direction from the upstream end to the downstream end; the belts spaced apart within the first plane;

a second set of belts, traveling within a second plane in a second direction from the downstream end toward the upstream end; the belts spaced apart within the second plane;

wherein the first and second sets of belts are in close proximity at the upstream end and are spaced apart at the downstream end, and the belts of the first set of belts are in alignment with the belts of the second set of belts; and a third set of belts positioned between the belts of the first set of belts and in the first plane; the third set of belts traveling in the first direction; the third set of belts comprising a lug on each belt, the lugs oriented along a common line;

wherein a web, in contact with the first set of belts, traveling in the first direction, and comprising a cigarette comprising a leading edge of the web, is wound around the cigarette by contact with the second set of belts at the upstream end; and wherein contact of the lugs with the leading edge of the web forms the cigarette.

2. The apparatus of claim 1, wherein contact of the lugs with the web separates the web into a downstream portion and an upstream portion;

the upstream portion comprising the leading edge.

3. The apparatus of claim 1, wherein the first set of belts travels at a first speed, and the second set of belts travels at a second speed lower than the first speed.

4. The apparatus of claim 1, wherein the web comprises a liquid add-on of at least about 25%.

5. The apparatus of claim 1, wherein the web comprises a liquid add-on of about 25% to about 700%.

6. The apparatus of claim 1, wherein the web is hydrophobic.

7. An apparatus for winding a web, comprising:

an upstream end;

a downstream end;

a first set of belts, traveling within a first plane in a first direction from the upstream end to the downstream end; the belts spaced apart within the first plane;

a second set of belts, traveling within a second plane in a second direction from the downstream end toward the upstream end; the belts spaced apart within the first plane;

wherein the first and second sets of belts are in close proximity at the upstream end and are spaced apart at the downstream end, and the belts of the first set of belts are in alignment with the space between the belts of the second set of belts;

a first set of skatewheels positioned between the belts of the first set of belts; and a second set of skatewheels positioned between the belts of the second set of belts, and positioned downstream from the first set of skatewheels;

wherein a web, in contact with the first set of belts, traveling in the first direction, and comprising a cigarette comprising a leading edge of the web, is wound around the cigarette by contact with the second set of belts at the upstream end;

wherein the first set of skatewheels pins the web against the second set of belts, and the second set of skatewheels pins the web against the first set of belts; the skatewheels cooperating to separate the web into a downstream portion and an upstream portion; the upstream portion comprising the leading edge, and the first set of skatewheels forming the cigarette.

8. The apparatus of claim 7, wherein the first set of belts travels at a first speed, and the second set of belts travels at a second speed lower than the first speed.

9. The apparatus of claim 7, wherein the web comprises a liquid add-on of at least about 25%.

10. The apparatus of claim 7, wherein the web comprises a liquid add-on of about 25% to about 700%.

11. The apparatus of claim 7, wherein the web is hydrophobic.

12. An apparatus for winding a web, comprising:

an upstream end;

a downstream end;

a first set of belts, traveling within a first plane in a first direction from the upstream end to the downstream end; the belts spaced apart within the first plane;

a second set of belts, traveling within a second plane in a second direction from the downstream end toward the upstream end; the belts spaced apart within the second plane;

wherein the first and second sets of belts are in close proximity at the upstream end and are spaced apart at the downstream end;

a fourth set of belts comprising belts spaced apart within a fourth plane and traveling in the first direction; and a fifth set of belts comprising belts spaced apart within a fifth plane parallel to the fourth plane and traveling in the first direction; the belts of the fifth set of belts in alignment with the belts of the fourth set of belts;

wherein a web, in contact with the first set of belts, traveling in the first direction, and comprising a cigarette comprising a leading edge of the web, is wound around the cigarette by contact with the second set of belts at the upstream end;

the fourth and fifth sets of belts delivering the web to the first set of belts.

13. The apparatus of claim 12, further comprising:

a sixth set of belts comprising belts positioned between the belts of the fourth set of belts and moving from a position behind the fourth plane to a position beyond the fourth plane; and a plurality of surfaces positioned between the belts of the fifth set of belts;

the motion of the sixth set of belts to the position beyond the fourth plane causing the web to be pinned between the surfaces and the sixth set of belts and separating the web into an upstream portion and a downstream portion.

14. The apparatus of claim 12, wherein the first set of belts travels at a first speed, and the second set of belts travel at a second speed lower than the first speed.

15. The apparatus of claim 12, wherein the web comprises a liquid add-on of at least about 25%.

16. The apparatus of claim 12, wherein the web comprises a liquid add-on of about 25% to about 700%.

17. The apparatus of claim 12, wherein the web is hydrophobic.

18. A method of forming a coreless roll of product, comprising:

supporting a web on a first set of belts traveling in a first direction from an upstream area to a downstream area;

forming a cigarette from the web;

contacting the cigarette with a second set of belts traveling in a second direction from the downstream area toward the upstream area;

winding the web around the cigarette; and breaking the web to form an upstream portion of the web and a downstream portion of the web, the upstream portion comprising a leading edge;

wherein the cigarette comprises the leading edge, and wherein the breaking the web comprises contacting the web with a plurality of lugs, the lugs attached to a third set of belts positioned between the belts of the first set of belts.

19. The method of claim 18, wherein the first set of belts travels at a first speed, and the second set of belts travels at a second speed lower than the first speed.

20. A method of forming a coreless roll of product, comprising:

supporting a web on a first set of belts traveling in a first direction from an upstream area to a downstream area;

forming a cigarette from the web;

contacting the cigarette with a second set of belts traveling in a second direction from the downstream area toward the upstream area;

winding the web around the cigarette; and breaking the web to form an upstream portion of the web and a downstream portion of the web, the upstream portion comprising a leading edge;

wherein the cigarette comprises the leading edge, and wherein the breaking the web comprises simultaneously pinning the web between a first set of skatewheels and the second set of belts and pinning the web between a second set of skatewheels and the first set of belts.

21. The method of claim 20, wherein the first set of belts travels at a first speed, and the second set of belts travels at a second speed lower than the first speed.

* * * * *